US012523018B2

(12) United States Patent
Kurasako et al.

(10) Patent No.: US 12,523,018 B2
(45) Date of Patent: Jan. 13, 2026

(54) MANAGEMENT APPARATUS AND MANAGEMENT SYSTEM FOR WORK MACHINE

(71) Applicant: Hitachi Construction Machinery Co., Ltd., Tokyo (JP)

(72) Inventors: Akira Kurasako, Tsuchiura (JP); Hideki Akita, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 157 days.

(21) Appl. No.: 18/688,868

(22) PCT Filed: Mar. 7, 2023

(86) PCT No.: PCT/JP2023/008666
§ 371 (c)(1),
(2) Date: Mar. 4, 2024

(87) PCT Pub. No.: WO2023/181922
PCT Pub. Date: Sep. 28, 2023

(65) Prior Publication Data

US 2024/0376696 A1 Nov. 14, 2024

(30) Foreign Application Priority Data

Mar. 24, 2022 (JP) ..... 2022-048998

(51) Int. Cl.
*E02F 9/26* (2006.01)
*E02F 9/22* (2006.01)

(52) U.S. Cl.
CPC ..... *E02F 9/267* (2013.01); *E02F 9/2203* (2013.01)

(58) Field of Classification Search
CPC . E02F 9/267; E02F 9/2203; E02F 9/20; E02F 9/26; F16N 29/00; G01N 33/2888;
(Continued)

(56) References Cited

U.S. PATENT DOCUMENTS 10,087,605 B2 10/2018 Nakamura et al.
2006/0200283 A1 9/2006 Furuno et al.
(Continued)

FOREIGN PATENT DOCUMENTS

JP 2005-82961 A 3/2005
JP 6234359 B2 11/2017
(Continued)

OTHER PUBLICATIONS

International Search Report (PCT/ISA/210) issued in PCT Application No. PCT/JP2023/008666 dated May 9, 2023 with English translation (4 pages).
(Continued)

*Primary Examiner* — Hunter B Lonsberry
*Assistant Examiner* — Henry R Hinton
(74) *Attorney, Agent, or Firm* — Crowell & Moring LLP

(57) ABSTRACT

A management apparatus and a management system for a work machine capable of increasing the accuracy in determining whether or not oil of a driving apparatus of the work machine is replaced with genuine oil are provided. A management server manages oil used in the driving apparatus of a hydraulic excavator. The management server includes an oil replacement history creation section that acquires a measurement value of a property of target oil from an oil sensor incorporated in the hydraulic excavator and is configured to create a replacement history of the target oil on the basis of a change of the property of the target oil, a worker access history creation section that acquires access information indicating that the hydraulic excavator is accessed by a worker, the worker access history creation section being configured to create a history of access to the hydraulic excavator by the worker on the basis of the access information, and an oil type determination section that is configured to determine an oil type of the target oil replaced in a
(Continued)

replacement timing corresponding to the replacement history, on the basis of the replacement history of the target oil and the access history of the worker.

5 Claims, 5 Drawing Sheets

(58) Field of Classification Search
CPC ..... G01N 33/30; G05B 23/0259; B60Y 2200/412
See application file for complete search history.

(56) References Cited

U.S. PATENT DOCUMENTS

2009/0241645 A1* 10/2009 Rains ..... F16N 29/00 184/6.4
2015/0160184 A1* 6/2015 Hanyuda ..... G01N 31/22 508/545
2022/0282455 A1 9/2022 Kurasako et al.
2023/0025611 A1* 1/2023 Endo ..... G07C 5/008

FOREIGN PATENT DOCUMENTS

JP 2021-38560 A 3/2021
JP 2021-71158 A 5/2021

OTHER PUBLICATIONS

Japanese-language Written Opinion (PCT/ISA/237) issued in PCT Application No. PCT/JP2023/008666 dated May 9, 2023 with English translation (6 pages).
International Preliminary Report on Patentability (PCT/IB/338 & PCT/IB/373) issued in PCT Application No. PCT/JP2023/008666 dated Oct. 3, 2024, including English translation of Written Opinion (PCT/ISA/237) (5 pages).

* cited by examiner

MANAGEMENT APPARATUS AND MANAGEMENT SYSTEM FOR WORK MACHINE

TECHNICAL FIELD

The present invention relates to a management apparatus and a management system for a work machine.

BACKGROUND ART

A driving apparatus incorporated in a work machine includes, for example, an engine, a circulation system for circulating engine oil used for lubrication and cooling of the engine, a hydraulic pump that is driven by the engine, and a hydraulic actuator that is driven by hydraulic oil delivered from the hydraulic pump.

Patent Document 1 discloses a computer for a server that collects, targeting oil used in a driving apparatus of a work machine (particularly, engine oil and hydraulic oil described above), a property of the oil measured by an oil sensor of the work machine. The computer for the server compares the property of the oil measured by the oil sensor with a predetermined threshold value to determine abnormality of the oil.

PRIOR ART DOCUMENT

Patent Document

Patent Document 1: JP-6234359

SUMMARY OF THE INVENTION

Problem to be Solved by the Invention

Although it is preferable to use genuine oil (in other words, oil recommended by a manufacturer of a work machine) for a driving apparatus of the work machine, non-genuine oil (in other words, oil that is not recommended by the manufacturer of the work machine) is sometimes used. It is important to know whether or not genuine oil is used in a driving apparatus of a work machine, for example, from the point of view of setting of a threshold value for determining abnormality of oil or determination of a maintenance timing.

As one of methods for determining, by a computer, whether or not genuine oil is used in a driving apparatus of a work machine, a possible method is one which uses a measurement result of an oil sensor. In particular, the computer determines a timing of replacement of oil from a change of a property of oil measured by the oil sensor. Then, the computer determines whether or not the oil of the driving apparatus of the work machine is replaced with genuine oil depending upon whether or not the property of oil immediately after the replacement measured by the oil sensor is the same as the property of the genuine oil.

However, the method described above has a problem in the accuracy in determination. In particular, even oil immediately after replacement suffers from variation in property arising from individual differences of oil or an influence of remaining oil. Thus, in such a case where properties of genuine oil and non-genuine oil are similar to each other, it is difficult to distinguish the genuine oil and the non-genuine oil from each other.

It is an object of the present invention to provide a management apparatus and a management system for a work machine capable of increasing the accuracy in determination of whether or not oil of a driving apparatus of the work machine is replaced with genuine oil.

Means for Solving the Problem

In order to attain the object described above, according to the present invention, there is provided a management apparatus that manages oil used in a driving apparatus of a work machine, including an oil replacement history creation section that acquires a measurement value of a property of target oil from an oil sensor incorporated in the work machine and is configured to create a replacement history of the target oil on the basis of a change of the property of the target oil, a worker access history creation section that acquires access information indicating that the work machine is accessed by a worker, the worker access history creation section being configured to create a history of access to the work machine by the worker, on the basis of the access information, and an oil type determination section that is configured to determine an oil type of the target oil replaced in a replacement timing corresponding to the replacement history on the basis of the replacement history of the target oil and the access history of the worker.

Advantages of the Invention

With the present invention, the accuracy in determination of whether or not oil of the driving apparatus of the work machine is replaced with genuine oil can be increased.

MODES FOR CARRYING OUT THE INVENTION

An embodiment of the present invention is described with reference to the drawings. It is to be noted that, in the present embodiment, a hydraulic excavator is taken as an example of a work machine.

Figure 1:
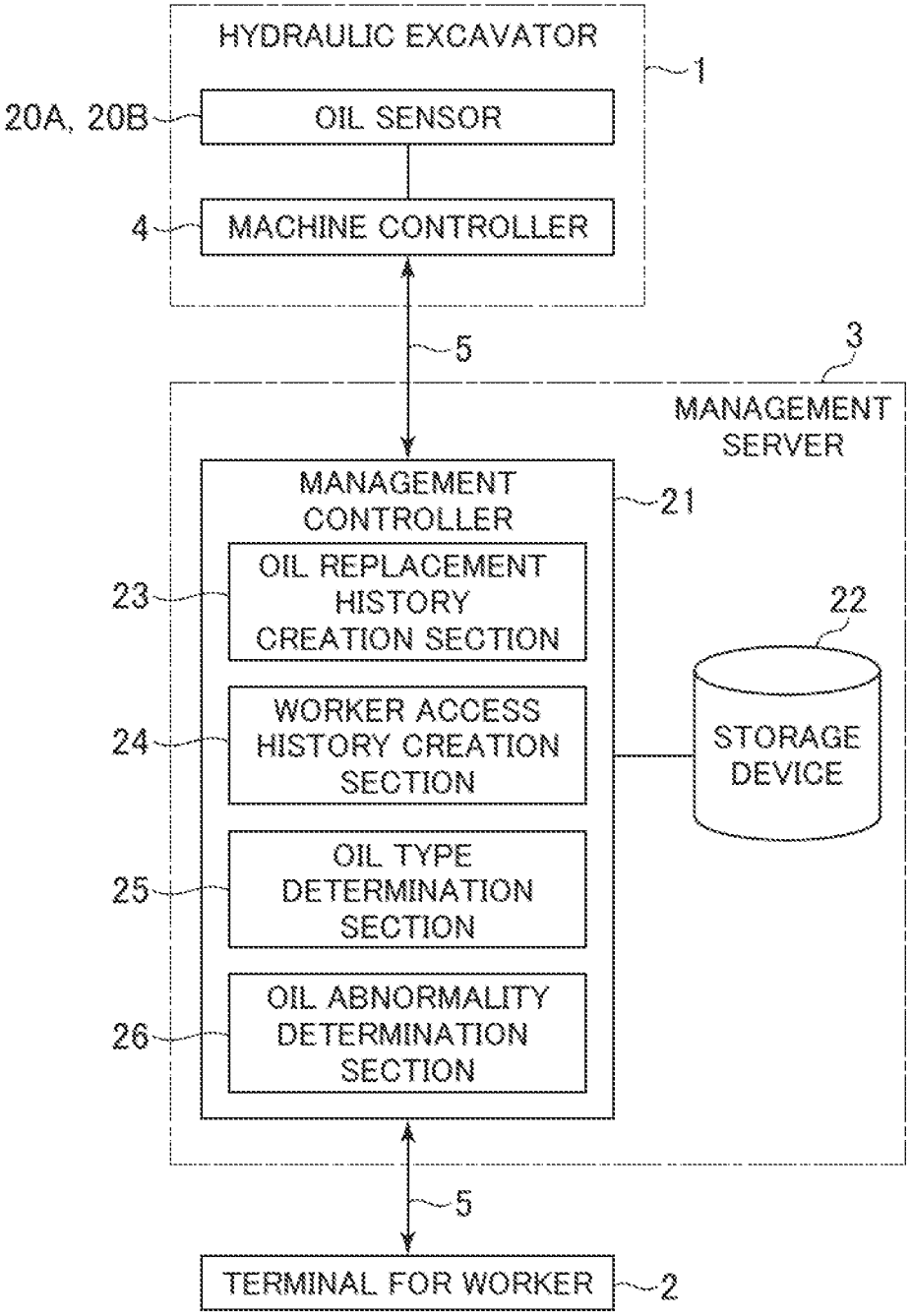
FIG. 1 is a block diagram depicting a configuration of a management system according to an embodiment of the present invention.
Figure 2:
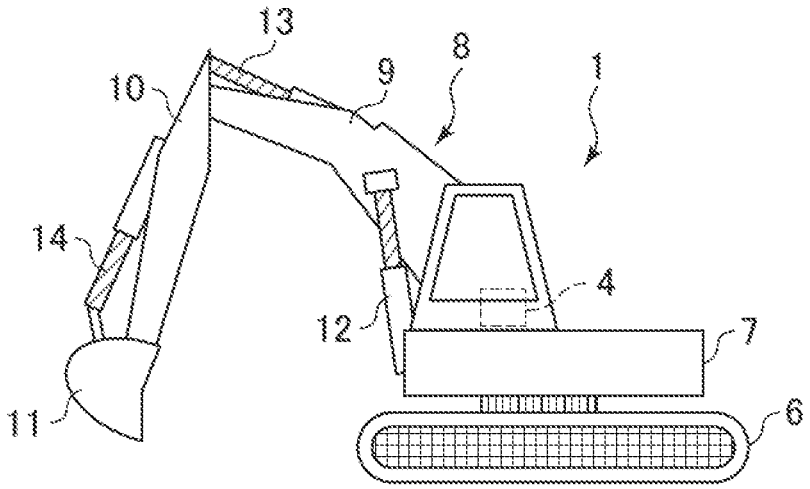
FIG. 2 is a side elevational view depicting a structure of a hydraulic excavator in the embodiment of the present invention.
Figure 3:
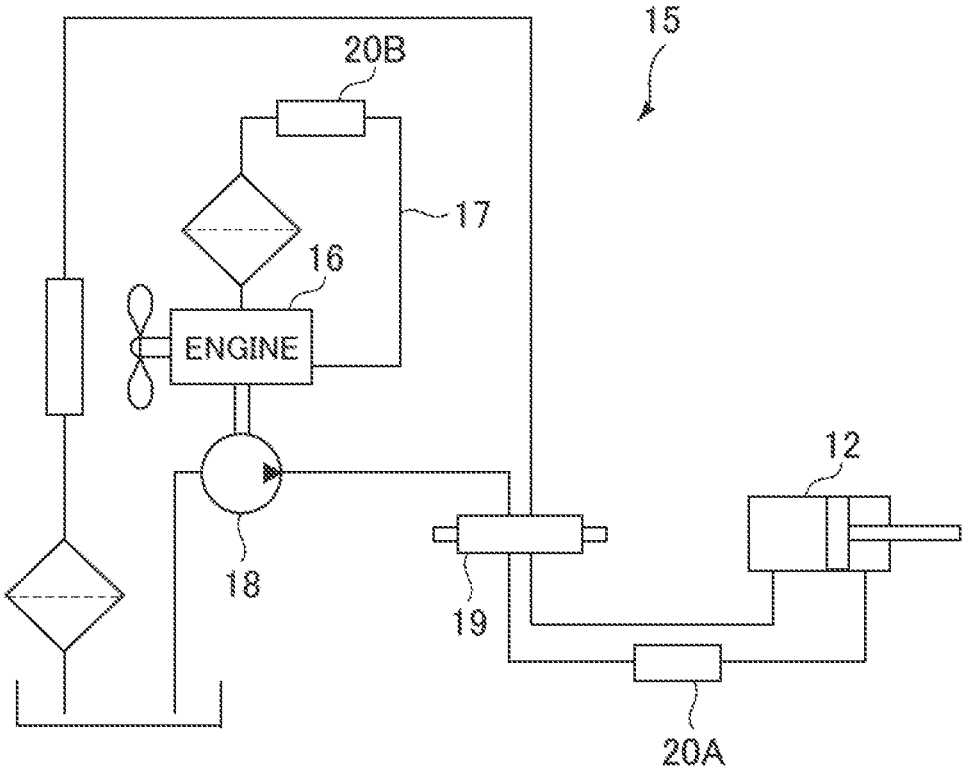
FIG. 3 is a schematic view depicting a configuration of a driving apparatus of the hydraulic excavator in the embodiment of the present invention.

FIG. 1 is a block diagram depicting a configuration of a management system according to the present embodiment. FIG. 2 is a side elevational view depicting a structure of a hydraulic excavator according to the present embodiment. FIG. 3 is a schematic view depicting a configuration of a driving apparatus of the hydraulic excavator according to the present embodiment. It is to be noted that, although, in FIG. 3, only a configuration relating to driving of a boom cylinder among configurations relating to driving of the plurality of hydraulic actuators (particularly, a plurality of control valves and so forth) is depicted for the convenience of illustration, also configurations relating to driving of the other hydraulic actuators are the same.

The management system of the present embodiment includes a hydraulic excavator 1, a terminal 2 owned by a worker who performs maintenance of the hydraulic excavator 1, and a management server 3 owned by a manufacturer of the hydraulic excavator 1. A machine controller 4 incorporated in the hydraulic excavator 1, the terminal 2 for a worker, and the management server 3 can communicate with each other through a communication network 5.

The hydraulic excavator 1 includes a lower track structure 6 that can travel, an upper swing structure 7 swingably provided on the upper side of the lower track structure 6, and a work apparatus 8 connected to the upper swing structure 7. The lower track structure 6 is caused to travel by rotation of travel motors (not depicted), and the upper swing structure 7 is swung by rotation of a swing motor (not depicted).

The work apparatus 8 includes a boom 9 pivotally connected to the upper swing structure 7, an arm 10 pivotally connected to a distal end portion of the boom 9, and a bucket 11 connected for pivotal portion to a distal end portion of the arm 10. The boom 9 is pivoted by extension and contraction of a boom cylinder 12; the arm 10 is pivoted by extension and contraction of an arm cylinder 13; and the bucket 11 is pivoted by extension and contraction of a bucket cylinder 14.

Though not depicted, the hydraulic excavator 1 includes a positioning device for measuring the position of the own machine. This positioning device has, for example, an antenna for receiving signals from satellites, and measures the position of the own machine on the basis of signals from satellites.

A driving apparatus 15 of the hydraulic excavator 1 includes an engine 16, a circulation system 17 that circulates engine oil that is used for lubrication and cooling of the engine 16, a hydraulic pump 18 that is driven by the engine 16, a plurality of hydraulic actuators (particularly, the travel motors, the swing motor, the boom cylinder 12, the arm cylinder 13, and the bucket cylinder 14 described hereinabove) that are driven by hydraulic oil delivered from the hydraulic pump 18, a plurality of control valves 19 that individually control flow of hydraulic oil from the hydraulic pump 18 to the plurality of hydraulic actuators, and a plurality of operation devices (not depicted) for operating the plurality of control valves 19.

In the present embodiment, an oil sensor 20A is provided in a hydraulic line, for example, between the boom cylinder 12 and the control valves 19 and measures a property of hydraulic oil (particularly, at least one of, for example, viscosity, density, permittivity, chromaticity, and particle density). Another oil sensor 20B is provided in the circulation system 17 and measures a property of engine oil.

Though not depicted, the machine controller 4 of the hydraulic excavator 1 includes a processor that executes processing in accordance with a program, a memory that stores programs and data, and so forth. The machine controller 4 temporarily stores a property of the hydraulic oil measured by the oil sensor 20A, a property of the engine oil measured by the oil sensor 20B, the position of the hydraulic excavator 1 measured by the positioning device, and so forth into the memory, and transmits them to the management server 3 at a predetermined cycle.

Though not depicted, the terminal 2 for a worker includes a processor that executes processing in accordance with a program, a memory that stores programs and data, an interface that allows inputting and display, and so forth. Further, the terminal 2 has a function for measuring the position of the own machine similarly to the positioning device of the hydraulic excavator 1, and transmits the position of the terminal 2 to the management server 3.

The management server 3 in the present embodiment has a function of collecting, targeting oil used in the driving apparatus 15 of the hydraulic excavator 1 (more particularly, the engine oil and the hydraulic oil described hereinabove), properties of the oil measured by the oil sensors 20A and 20B of the hydraulic excavator 1, and corresponds to the management apparatus described in the claims. In the following description, the oil that becomes a target of measurement of the oil sensor 20A or 20B (that is, the oil that becomes a management target) is sometimes referred to as target oil, and in the present embodiment, the hydraulic oil or the engine oil is the target oil.

The management server 3 includes a management controller 21 and a storage device 22. Though not depicted, the management controller 21 includes a processor that executes processing in accordance with a program, a memory that stores programs and data, and so forth. The memory of the management controller 21 temporarily stores time series data concerning a property of the hydraulic oil acquired from the machine controller 4, time series data concerning a property of the engine oil, and so forth. The processor of the management controller 21 processes the data stored in the memory and stores data created by the process into the storage device 22.

The storage device 22 is, for example, a hard disk that builds a database and stores data concerning the hydraulic excavator 1 acquired from the machine controller 4 (particularly, running data of the hydraulic excavator 1 and so forth), data acquired from the terminal 2 for a worker and so forth (particularly, a work report, a part purchase history, and so forth relating to the hydraulic excavator 1), data created by the management controller 21 (particularly, a replacement history of the oil relating to the hydraulic excavator 1, an access history of the worker, and so forth), and data concerning a plurality of types of oil acquired in advance (particularly, a property of genuine oil in a new condition, a threshold value for a property set in advance for each of the types of oil for abnormality determination of genuine oil or non-genuine oil, and so forth).

The management controller 21 includes, as functional configurations thereof, an oil replacement history creation section 23, a worker access history creation section 24, an oil type determination section 25, and an oil abnormality determination section 26.

Figure 4:
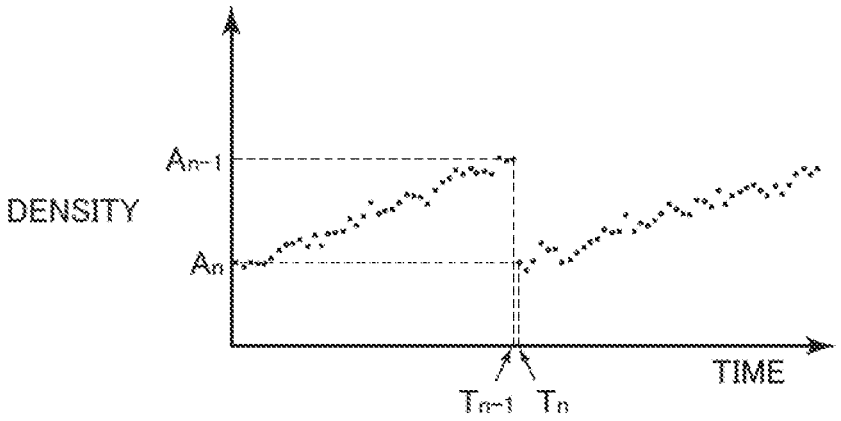
FIG. 4 is a diagram illustrating determination of an oil replacement timing by a management controller of a management server in the embodiment of the present invention.

The oil replacement history creation section 23 of the management controller 21 determines a replacement timing of hydraulic oil of the driving apparatus 15 of the hydraulic excavator 1, by using the time series data concerning the hydraulic oil acquired from the machine controller 4. In particular, the oil replacement history creation section 23 determines a period from time $I_{n-1}$ to time $T_n$ as a replacement timing of the hydraulic oil in a case where an amount of change ($A_n$-$A_{n-1}$) of a property of the hydraulic oil (note that, although a property is depicted taking density as an example in FIG. 4, also a different property may be applicable) exceeds a predetermined value (particularly, a value set in advance taking deterioration of the hydraulic oil and an error of measurement of the oil sensor into consideration) (particularly, determines that the hydraulic oil that is target oil is replaced in the timing). Then, the oil replacement history creation section 23 creates a replacement history of the hydraulic oil (for example, a replacement date of the oil) in regard to the hydraulic excavator 1 and stores it into the storage device 22.

The oil replacement history creation section 23 of the management controller 21 determines a replacement timing of engine oil of the driving apparatus 15 of the hydraulic excavator 1 (that is, determines that the engine oil that is target oil for replacement is replaced in the timing) by using the time series data concerning the engine oil acquired from the machine controller 4. Then, the oil replacement history creation section 23 creates a replacement history of the engine oil in regard to the hydraulic excavator 1 and stores it into the storage device 22.

The worker access history creation section 24 of the management controller 21 acquires information (access information) indicating that a predetermined worker (for example, a worker who performs a service work) has accessed (contacted or approached) the hydraulic excavator 1. In the present embodiment, the worker access history creation section 24 acquires time series data concerning the position of the hydraulic excavator 1 from the machine controller 4 and acquires time series data concerning the position of the terminal 2 from the terminal 2 for a worker individually as access information regarding the worker. Then, the worker access history creation section 24 uses this access information to determine a timing of access to the hydraulic excavator 1 by the worker. In other words, the access information is information that indicates that the worker performs a work for the hydraulic excavator 1 (work machine) and that the worker has accessed (contacted or approached with an intention) the hydraulic excavator 1 in order to perform a work.

In particular, the worker access history creation section 24 first computes the distance between the hydraulic excavator 1 and the terminal 2 and determines whether the hydraulic excavator 1 is accessed by the worker depending upon whether the distance is within a predetermined value (for example, 2 m). Then, the worker access history creation section 24 creates a history of access to the hydraulic excavator 1 by the worker (for example, an access date of the worker and an access period of the worker on the day) and stores it into the storage device 22.

The oil type determination section 25 of the management controller 21 determines an oil type of the hydraulic oil on the basis of the replacement history of the hydraulic oil (target oil) and the access history of the worker with respect to the hydraulic excavator 1 described hereinabove. In the present embodiment, the oil type determination section 25 determines, for example, whether the hydraulic oil of the driving apparatus 15 of the hydraulic excavator 1 is replaced with predetermined genuine oil (for example, genuine oil A or B, or the like) (details are hereinafter described). Then, the oil type determination section 25 stores the type of the hydraulic oil (for example, the genuine oil A or B, non-genuine oil, or the like) in association with the replacement history of the hydraulic oil into the storage device 22.

The oil abnormality determination section 26 of the management controller 21 reads in a threshold value for the property corresponding to the type of the hydraulic oil of the driving apparatus 15 of the hydraulic excavator 1 from the storage device 22. Then, the oil abnormality determination section 26 compares the time series data concerning the property of the hydraulic oil acquired from the machine controller 4 of the hydraulic excavator 1 with the threshold value, to determine abnormality of the hydraulic oil. In other words, the oil abnormality determination section 26 determines presence or absence of abnormality of the hydraulic oil by the threshold value corresponding to the oil type of the hydraulic oil (target oil) determined by the oil type determination section 25.

Figure 5:
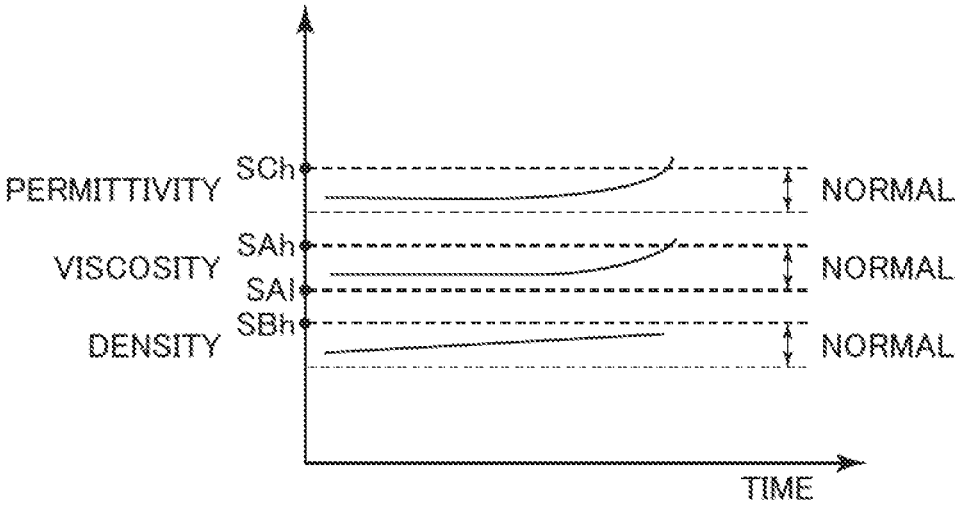
FIG. 5 is a view illustrating determination of oil abnormality by the management controller of the management server in the embodiment of the present invention.

Described particularly, in a case where the hydraulic oil of the driving apparatus 15 of the hydraulic excavator 1 is the genuine oil A, the oil abnormality determination section 26 of the management controller 21 reads in an upper threshold value SAh and a lower threshold value SAl for the viscosity, an upper threshold value SBh for the density, and an upper threshold value SCh for the permittivity corresponding to the genuine oil A from the storage device 22. Further, in a case where the viscosity of the hydraulic oil measured by the oil sensor 20A is higher than the upper threshold value SAh as depicted in FIG. 5, the oil abnormality determination section 26 determines that the hydraulic oil is abnormal. Alternatively, in a case where the viscosity of the hydraulic oil measured by the oil sensor 20A is lower than the lower threshold value SAI, the oil abnormality determination section 26 determines that the hydraulic oil is abnormal. Further, in a case where the density of the hydraulic oil measured by the oil sensor 20A is higher than the upper threshold value SBh, the oil abnormality determination section 26 determines that the hydraulic oil is abnormal. Further, in a case where the permittivity of the hydraulic oil measured by the oil sensor 20A is higher than the upper threshold value SCh as depicted in FIG. 5, the oil abnormality determination section 26 determines that the hydraulic oil is abnormal.

The oil type determination section 25 of the management controller 21 determines an oil type of the engine oil on the basis of the replacement history of the engine oil (target oil) and the access history of the worker with respect to the hydraulic excavator 1. In the present embodiment, the oil type determination section 25 determines, for example, whether the engine oil of the driving apparatus 15 of the hydraulic excavator 1 is replaced with predetermined genuine oil (for example, genuine oil C or D, or the like). Then, the oil type determination section 25 stores the type of the engine oil (for example, the genuine oil C or D, non-genuine oil, or the like) in association with the replacement history of the engine oil into the storage device 22.

The oil abnormality determination section 26 of the management controller 21 reads in a threshold value for the property corresponding to the type of the engine oil of the driving apparatus 15 of the hydraulic excavator 1 from the storage device 22. Then, the oil abnormality determination section 26 compares time series data concerning the property of the engine oil acquired from the machine controller 4 of the hydraulic excavator 1 with the threshold value, to determine abnormality of the engine oil. In particular, the oil abnormality determination section 26 determines presence or absence of abnormality of the engine oil by the threshold value corresponding to the oil type of the engine oil (target oil) determined by the oil type determination section 25.

Figure 6:
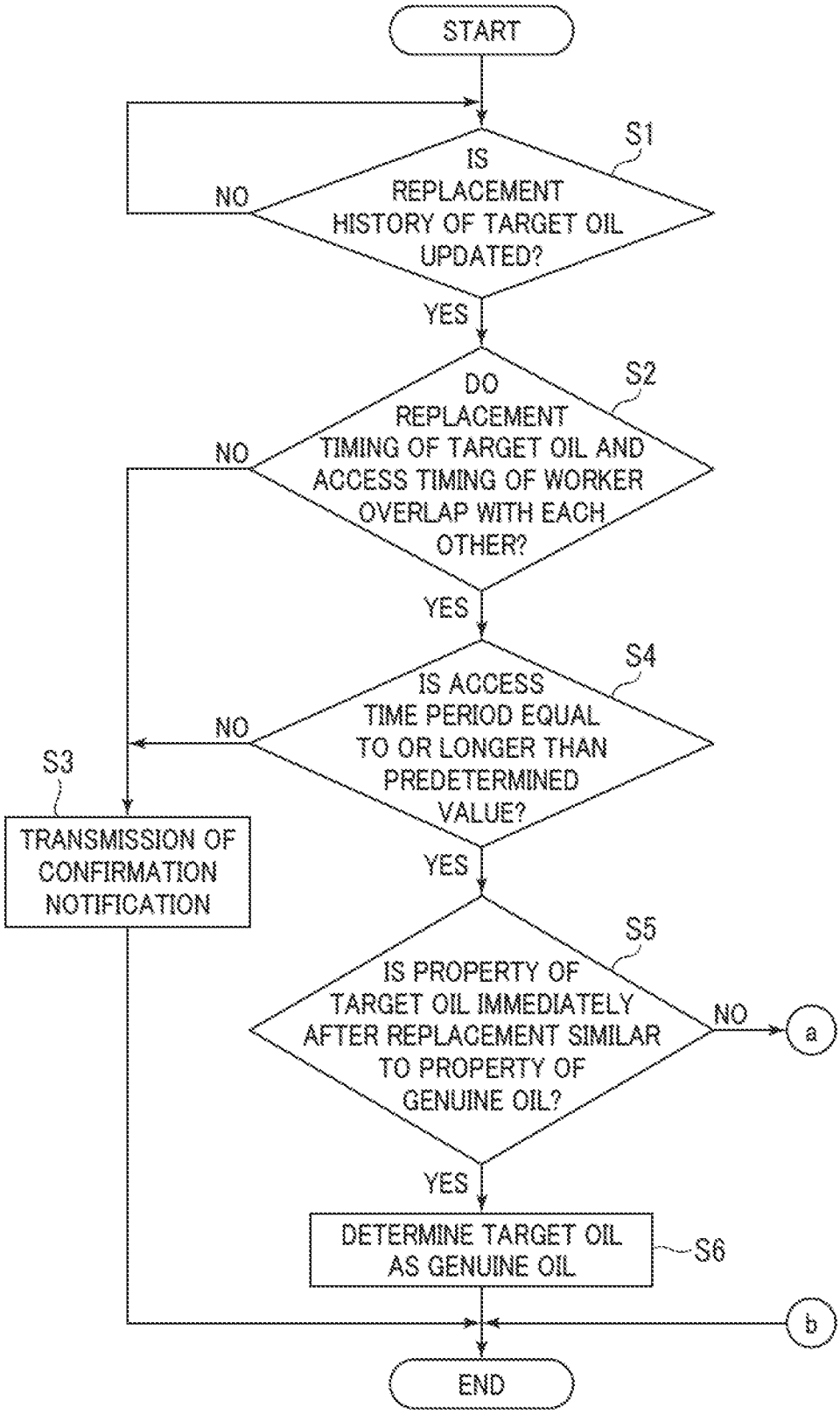
FIG. 6 is a flow chart depicting part of a processing procedure relating to determination of an oil type by the management controller of the management server in the embodiment of the present invention.
Figure 7:
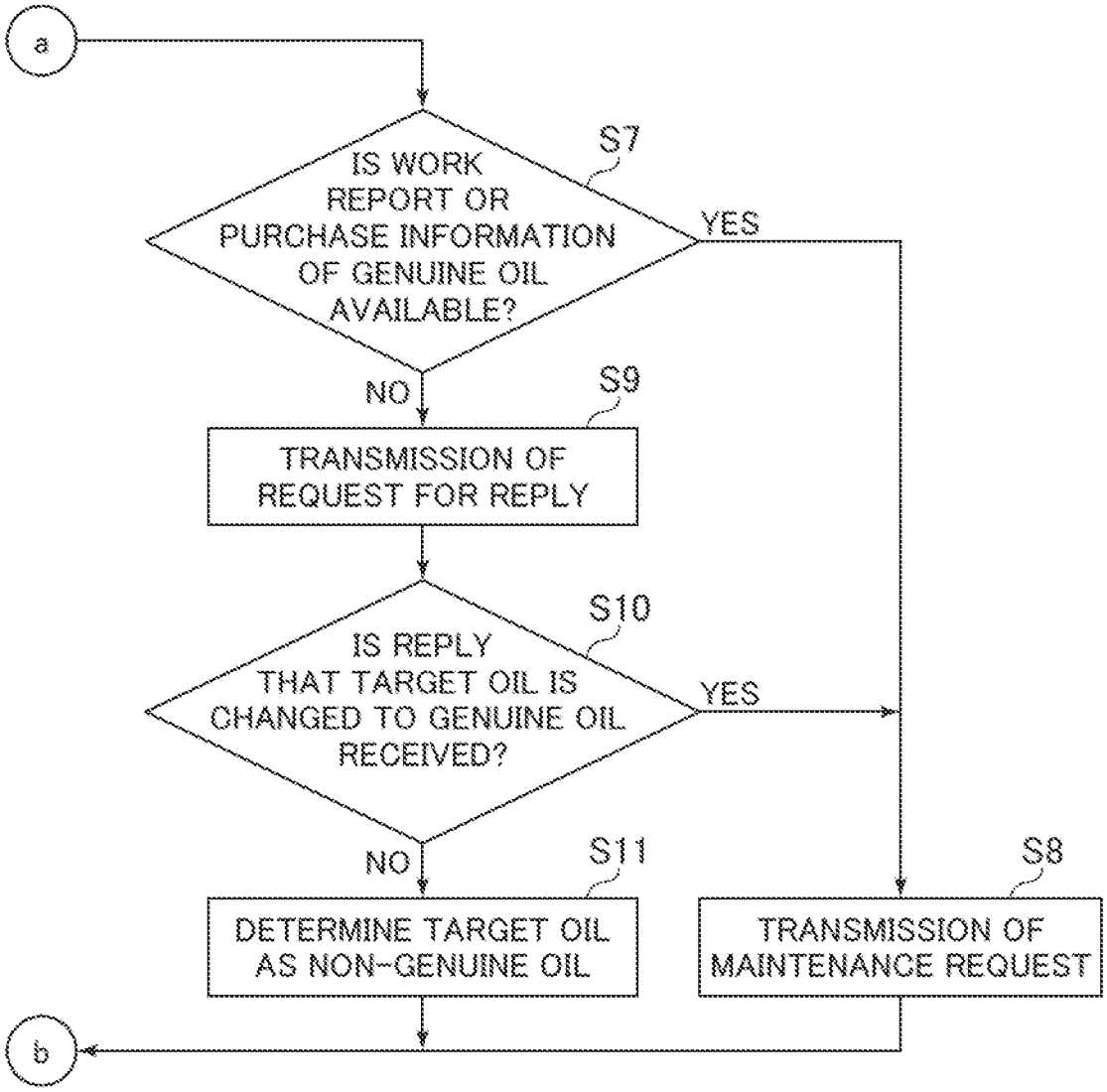
FIG. 7 is a flow chart depicting part of the processing procedure relating to determination of an oil type by the management controller of the management server in the embodiment of the present invention.

Now, a processing procedure for determining an oil type by the management controller 21 of the management server 3 in the present embodiment is described with reference to FIGS. 6 and 7. FIGS. 6 and 7 are flow charts representing a processing procedure for determining an oil type by the management controller of the management server in the present embodiment. Here, description is given with the engine oil and the hydraulic oil collectively referred to as the "target oil."

In step S1, the oil type determination section 25 of the management controller 21 determines whether an replacement history of the target oil regarding the hydraulic excavator 1 is updated. In a case where the replacement history of the target oil regarding the hydraulic excavator 1 is updated, the processing advances to step S2.

In step S2, the oil type determination section 25 of the management controller 21 determines whether a replacement timing of the target oil (for example, a replacement date of the oil) and a timing of access by the worker (for example, a date of access by the worker) with respect to the hydraulic excavator 1 overlap with each other.

In a case where a replacement timing of the target oil and a timing of access by the worker with respect to the hydraulic excavator 1 do not overlap with each other, the processing advances to step S3. In step S3, the oil type determination section 25 of the management controller 21 transmits a confirmation notification to a terminal (not depicted) owned by the user of the hydraulic excavator 1. This allows the user to confirm, for example, whether a replacement work of oil has been performed.

On the other hand, in a case where a replacement timing of the target oil and a timing of access by the worker with respect to the hydraulic excavator 1 overlap with each other, the processing advances to step S4. In step S4, the oil type determination section 25 of the management controller 21 determines whether the time period of access to the hydraulic excavator 1 by the worker is equal to or longer than a predetermined time period (particularly, a value that is set in advance with a period of time necessary for a replacement work of the oil taken into configuration and is, for example, 0.5 hours).

In a case where the time period of access to the hydraulic excavator 1 by the worker is shorter than the predetermined time period, the processing advances to step S3. In step S3, the oil type determination section 25 of the management controller 21 transmits a confirmation notification to the terminal 2 for the worker. This allows confirmation, for example, of whether addition of oil is performed by the worker.

On the other hand, in a case where the time period of access to the hydraulic excavator 1 by the worker is equal to or longer than the predetermined time period, the processing advances to step S5. In step S5, the oil type determination section 25 of the management controller 21 extracts, from pieces of time series data concerning the property of the target oil acquired from the machine controller 4, a property (in FIG. 4, An) of the target oil immediately after the replacement. Then, the oil type determination section 25 determines whether the property of the target oil immediately after the replacement is similar to the property of the genuine oil in a new condition stored in the storage device 22 (in other words, whether a difference of the property is equal to or smaller than a predetermined value).

In a case where the property of the target oil immediately after the replacement is similar to the property of the genuine oil in a new condition, the processing advances to step S6. In step S6, the oil type determination section 25 of the management controller 21 determines that the target oil of the driving apparatus 15 of the hydraulic excavator 1 is replaced with the genuine oil. Then, the oil type determination section 25 stores the type of the target oil in association with the replacement history of the target oil into the storage device 22.

On the other hand, in a case where the property of the target oil immediately after the replacement is not similar to the property of the genuine oil in a new condition, the processing advances to step S7. In step S7, the oil type determination section 25 of the management controller 21 determines whether purchase information concerning the genuine oil is included in a work report on the day (in other words, the date of replacement of the target oil or the date of access by the worker) or in a part purchase history before the day in regard to the hydraulic excavator 1 that is stored in the storage device 22.

In a case where purchase information concerning the genuine oil is included in the work report on the day or in the part purchase history before the day that is stored in the storage device 22, the processing advances to step S8. In step S8, the oil type determination section 25 of the management controller 21 determines that, while there is a possibility that the target oil replaced may be the genuine oil, the measurement value of the oil sensor is abnormal, and transmits a request for maintenance of the hydraulic excavator 1 to the terminal 2 for the worker. It is to be noted that the cause of abnormality of the measurement value of the oil sensor is, for example, an influence of remaining oil, a defect of the sensor, or the like. In particular, it is considered that this case is equivalent to a case in which the ratio of the new oil in the genuine oil is low while the sensor is normal or another case in which the sensor suffers from some kinds of defect.

On the other hand, in a case where purchase information concerning the genuine oil is not included in the work report on the day or in the part purchase history before the day that is stored in the storage device 22, the processing advances to step S9. In step S9, the oil type determination section 25 of the management controller 21 transmits a request for reply as to whether the target oil of the driving apparatus 15 of the hydraulic excavator 1 is replaced with the genuine oil to the terminal 2 for the worker. Thereafter, in step S10, the oil type determination section 25 of the management controller 21 determines whether a reply that the target oil of the driving apparatus 15 of the hydraulic excavator 1 is replaced with genuine oil is received. In particular, in this case, the oil type determination section 25 performs replacement confirmation for the target oil with the worker before it determines an oil type of the target oil replaced in the replacement timing.

In a case where a reply that the target oil of the driving apparatus 15 of the hydraulic excavator 1 is replaced with the genuine oil is received, the processing advances to step S8. In step S8, the oil type determination section 25 of the management controller 21 determines that, while there is a possibility that the target oil replaced in the replacement timing may be the genuine oil, the measurement value of the oil sensor is abnormal, and transmits a request for maintenance of the hydraulic excavator 1 to the terminal 2 for the worker.

In contrast, in a case where a reply that the target oil of the driving apparatus 15 of the hydraulic excavator 1 is changed to the non-genuine oil is received, the processing advances to step S11. In step S11, the oil type determination section 25 of the management controller 21 determines that the target oil of the driving apparatus 15 of the hydraulic excavator 1 is replaced with non-genuine oil. Then, the oil type determination section 25 stores the type of the target oil (non-genuine oil) in association with the replacement history of the target oil into the storage device 22.

In this manner, in the present embodiment, whether the target oil of the driving apparatus 15 of the hydraulic excavator 1 is replaced with the genuine oil is determined not only on the basis of a measurement result of the oil sensor of the hydraulic excavator 1 but also on the basis of the history of access to the hydraulic excavator 1 by the worker. Therefore, the accuracy in determination as to whether the target oil of the driving apparatus 15 of the hydraulic excavator 1 is replaced with the genuine oil can be improved. As a result, the accuracy in abnormality determination of the target oil and in determination of the maintenance timing can be improved.

It is to be noted that, although the embodiment is described above taking a case in which the management controller 21 of the management server 3 includes the oil replacement history creation section 23, the worker access history creation section 24, and the oil type determination section 25 as an example, this is not restrictive. For example, the machine controller 4 of the hydraulic excavator 1 may include the oil replacement history creation section 23 while the management controller 21 of the management server 3 may include the worker access history creation section 24 and the oil type determination section 25. Alternatively, for example, the machine controller 4 of the hydraulic excavator 1 may include the oil replacement history creation section 23 and the worker access history creation section 24 while the management controller 21 of the management server 3 may include the oil type determination section 25.

Further, although the embodiment is described above taking a case in which the hydraulic excavator 1 includes the positioning device that measures the position of the own machine, the terminal 2 for a worker has the function of measuring the position of the own machine, and the worker access history creation section 24 creates a history of access to the hydraulic excavator 1 by the worker on the basis of the position of the hydraulic excavator 1 and the position of the terminal 2 described hereinabove as an example, this is not restrictive. For example, the worker may own an RFID (Radio Frequency Identification) tag, and the hydraulic excavator 1 may include a receiver that receives a radio wave from the RFID to detect approach of the RFID and thereby allow the worker access history creation section 24 to create a history of access to the hydraulic excavator 1 by the worker, on the basis of information concerning approach of the RFID to the hydraulic excavator 1 described above.

It is to be noted that, although the foregoing description is given taking a case where the work machine is a hydraulic excavator as an example, this is not restrictive, and the work machine may otherwise be, for example, a dump truck, a wheel loader, a bulldozer, a forklift, or a crane. Further, although the foregoing description is given taking a case in which the oil used in the driving apparatus of the work machine is both hydraulic oil and engine oil, this is not restrictive, and the oil may be only one of hydraulic oil and engine oil or may be some other oil. In other words, the oil that becomes a management target (target oil) may be any of various kinds of oil. In this case, it is sufficient if various kinds of information are acquired from the work machine in which an oil sensor capable of measuring a property of the oil that becomes the target is incorporated.

Description of Reference Characters

1: Hydraulic excavator (work machine)
2: Terminal
3: Management server (management apparatus)
15: Driving apparatus
20A, 20B: Oil sensor
23: oil replacement history creation section
24: Worker access history creation section
25: oil type determination section

The invention claimed is:

1. A management apparatus that manages oil used in a driving apparatus of a work machine, comprising:

an oil replacement history creation section that acquires a measurement value of a property of target oil from an oil sensor incorporated in the work machine and is configured to create a replacement history of the target oil on a basis of a change of the property of the target oil;

a worker access history creation section that acquires access information indicating that the work machine is accessed by a worker, the worker access history creation section being configured to create a history of access to the work machine by the worker, on a basis of the access information; and an oil type determination section that is configured to determine an oil type of the target oil replaced in a replacement timing corresponding to the replacement history on a basis of the replacement history of the target oil and the access history of the worker, wherein the oil type determination section is configured to:

determine, in a case where the replacement timing of the target oil and a timing of access by the worker overlap with each other, a time period of access by the worker is equal to or longer than a predetermined time period, and the property of the target oil measured by the oil sensor after the replacement timing is a property corresponding to a property of predetermined genuine oil, that the target oil replaced in the replacement timing is the genuine oil, the management apparatus further comprising:

an oil abnormality determination section that is configured to determine presence or absence of abnormality of the target oil by a threshold value corresponding to the oil type of the target oil determined by the oil type determination section.

2. The management apparatus for a work machine according to claim 1, wherein the oil type determination section is configured to acquire, in a case where the replacement timing of the target oil and the timing of access by the worker overlap with each other, the time period of access by the worker is equal to or longer than the predetermined time period, and the property of the target oil measured by the oil sensor after the replacement timing is not a property corresponding to a property of predetermined genuine oil, information relating to presence or absence of a work report of the worker or presence or absence of purchase information concerning the genuine oil with respect to the work machine, and determine, in a case where the work report or the purchase information concerning the genuine oil is present, that, although there is a possibility that the target oil replaced in the replacement timing may be the genuine oil, the measurement value of the oil sensor is abnormal.

3. The management apparatus for a work machine according to claim 2, wherein the oil type determination section is configured to transmit, where none of the work report and the purchase information concerning the genuine oil is present, a request for reply as to whether the target oil is replaced with the genuine oil to a terminal owned by the worker before the oil type of the target oil replaced in the replacement timing is determined.

4. The management apparatus for a work machine according to claim 3, wherein the oil type determination section is configured to determines, in a case where a reply that the target oil is replaced with predetermined non-genuine oil is received from the terminal of the worker, that the target oil replaced in the replacement timing is the non-genuine oil.

5. A management system comprising:

a work machine including a driving apparatus and an oil sensor that measures a property of oil used in the driving apparatus; and a management apparatus that is able to communicate with the work machine and manages the oil used in the driving apparatus, wherein the management apparatus includes an oil replacement history creation section that acquires a measurement value of a property of target oil from the oil sensor and is configured to create a replacement history of the target oil on a basis of a change of the property of the target oil, a worker access history creation section that acquires access information indicating that the work machine is accessed by a worker, the worker access history creation section being configured to create a history of access to the work machine by the worker on a basis of the access information, an oil type determination section that is configured to determine an oil type of the target oil replaced in a replacement timing corresponding to the replacement history, on a basis of the replacement history of the target oil and the access history of the worker, and an oil abnormality determination section that is configured to determine presence or absence of abnormality of the target oil by a threshold value corresponding to the oil type of the target oil determined by the oil type determination section, wherein the oil type determination section is configured to:

determine, in a case where the replacement timing of the target oil and a timing of access by the worker overlap with each other, a time period of access by the worker is equal to or longer than a predetermined time period, and the property of the target oil measured by the oil sensor after the replacement timing is a property corresponding to a property of predetermined genuine oil, that the target oil replaced in the replacement timing is the genuine oil.

* * * * *